United States Patent [19]

Tighe, Jr.

[11] Patent Number: 4,660,918

[45] Date of Patent: Apr. 28, 1987

[54] HIGH DENSITY COAXIAL CABLE CONNECTOR

[75] Inventor: Charles I. Tighe, Jr., Hershey, Pa.

[73] Assignee: AMP Incorporated, Harrisburg, Pa.

[21] Appl. No.: 797,110

[22] Filed: Nov. 12, 1985

[51] Int. Cl.[4] ..... H01R 4/24

[52] U.S. Cl. ..... 339/97 P

[58] Field of Search ..... 339/97 R, 97 P, 98, 339/99 R

[56] References Cited

U.S. PATENT DOCUMENTS 4,350,404 9/1982 Clark et al. ..... 339/99 R

*Primary Examiner*—Joseph H. McGlynn

*Attorney, Agent, or Firm*—Gerald K. Kita

[57] ABSTRACT

A high density coaxial cable connector is achieved by staggering slot defining fingers at different positions along the axis along which cables are aligned. The fingers of two opposing connector portions are offset in a manner to nest with one another thus using common space to increase packing density. The resulting connectors can be organized so that they nest into a compact stack which provide for increased cable termination density along each of two axes.

9 Claims, 4 Drawing Figures

HIGH DENSITY COAXIAL CABLE CONNECTOR

FIELD OF THE INVENTION

The invention relates to connectors for coaxial cables.

BACKGROUND OF THE INVENTION

Coaxial cables are available in the form of a ribbon with signal carrying cables and associated ground conductors organized as parallel strands all electronically insulated from one another. A connector at which such a cable is terminated is a fairly complicated structure adapted to connect the signal carrying cables and the associated ground conductors to respective terminals of the connector. The terminals reside in parallel channels in the connector body. Typically, the signal cables are connected to terminals on one face of the connector body portion and the associated ground conductors are connected to terminals on the other face.

The connector typically comprises first and second cover portions which mate with the body portion of the connector. The cover portions have internal configurations adapted to constrain the cables and ground conductors in the respective terminal channels, to further insulate the individual cables, to constrain the cable sheathing from movement, and to securely anchor the cables. The cover portions are also configured to mate with the body portion to form a sandwich defining a pin-receiving edge in which the cover portions and the body portion form an array of pin-receiving apertures.

Although coaxial cable connectors of the type described are in large scale use in industry today, attempts to reduce the size of connectors of this type have been limited by the physical demands of the terminating elements and insulating requirements of the structure. Yet the drive for increasingly smaller connectors is never ending, propelled not only by the reduction in size of electronic equipment but also by the desire to reduce materials and thus costs.

BRIEF DESCRIPTION OF THE INVENTION

The invention is based on the recognition that the size limitation of a coaxial cable connector is dictated by the requisite spacing between adjacent channels in the body portion of the connector. In accordance with the principles of the present invention, the size constraints imposed by the physical requirements of connector channels are eased considerably by, in a sense, varying the positions of the terminal connections to signal cables and ground conductors in a first connector plane and by providing for a pin-receiving aperture on *alternative* terminals. An opposing connector plane is similarly organized, but has its elements offset to interleave with like elements of the first plane. The two planes close together like the covers of a book, the elements of each being configured and arranged in positions which are electrically insulated from the elements of the other plane. Each plane may include connect and terminal elements on each face permitting a stacking of the planes into a compact and high density connector for an array of cables.

The arrangements permit a simple, high density, and inexpensive wire management system to be achieved for the mass termination of electrical conductors.

DETAILED DESCRIPTION

Figure 1:
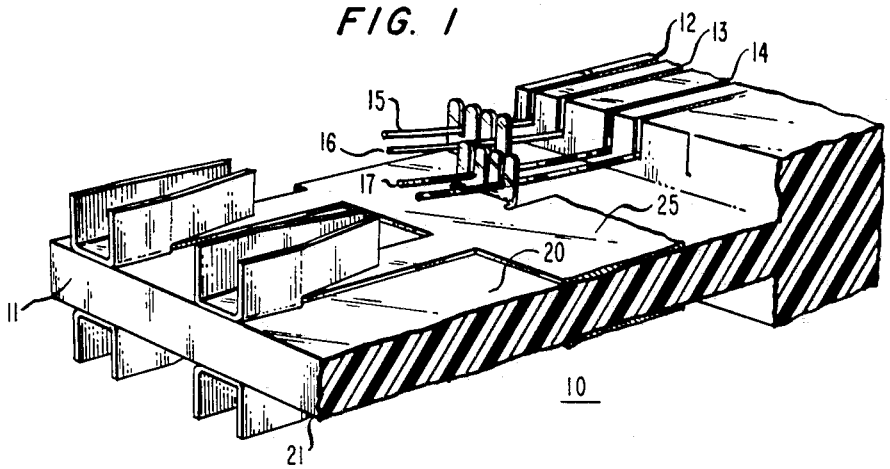
FIG. 1 shows an enlarged view of a high density connector.

FIG. 1 shows an enlarged view of a fragment 10 of a high density connector in accordance with the principles of this invention. The fragment comprises a block 11 of plastic on each face of which electrically conducting terminals are mounted. Block 11, of course, is electrically insulating and is configured with channels 12, 13, and 14 into which individual cables or ground conductors 15, 16, and 17 of a coaxial cable may be routed. We will adopt the convention that ground conductors are routed through parallel channels in the top face 20 of block 11 of FIG. 1 and signal cables are routed through parallel channels in the bottom face 21 of block 11.

The terminals for the ground conductors are conveniently fabricated from a single element 25 of electrically conducting material such as copper alloys.

Figure 2:
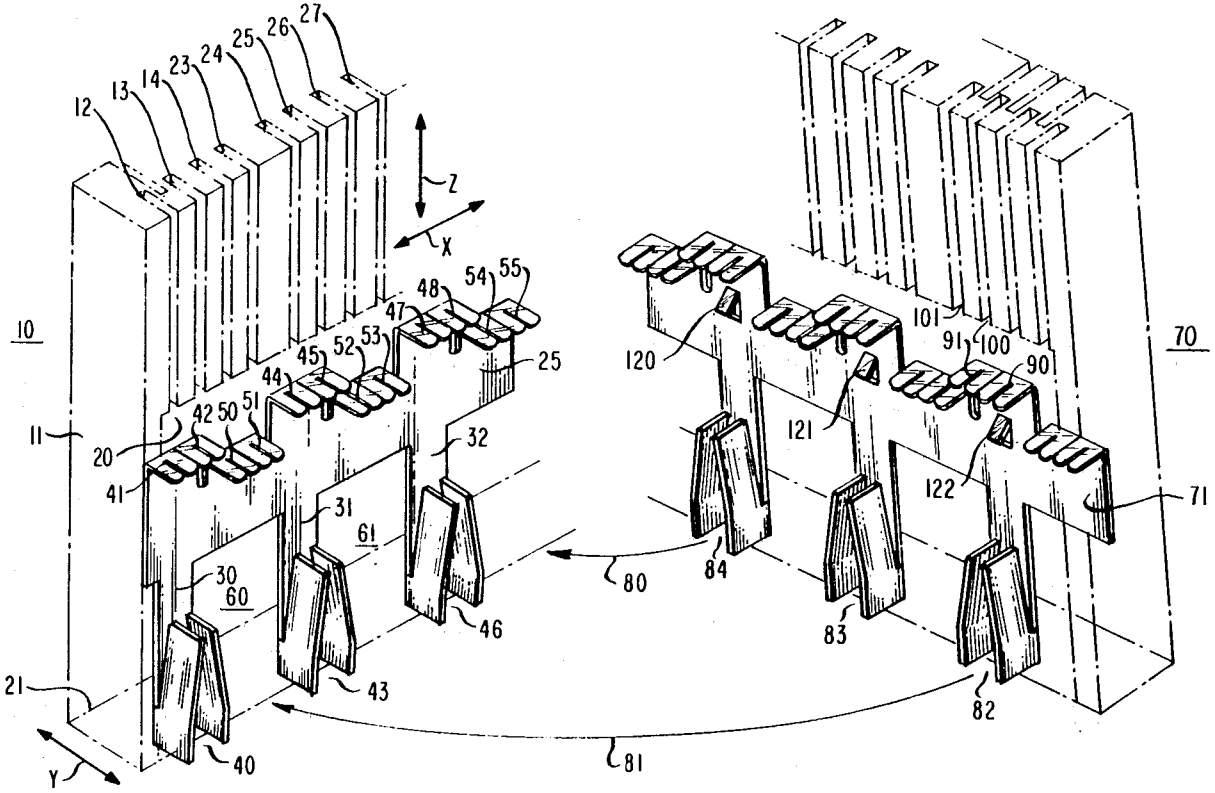
FIG. 2 is an exploded view of FIG. 1.

FIG. 2 shows the fragment of FIG. 1 erect to expose face 20 displaying element 25. The element can be seen to comprise a plurality of segments of alternative shapes all interconnected into a single element. Segments of a first of those alternative shapes are designated 30, 31, and 32 in FIG. 2. Each of those segments includes a pair of resilient arms at the bottom of the fragment as viewed. The opposite (top) end of the segment comprises two pair of resilient fingers adapted to cut sheathing and make electrical contact to ground conductors urged between a pair of fingers. The pair of resilient arms for segment 30 is designated 40. The associated pairs of fingers define slots 41 and 42 for receiving ground conductors. The pair of resilient arms for segment 31 is designated 43 and the associated slots are designated 44 and 45. Similarly, the pair of resilient arms for segment 32 is designated 46 and the associated pair of finger-defining slots, 47 and 48. Segments 30, 31, and 32 are separated by pairs of fingers which are positioned relatively low compared to pair of fingers which define slots 41, 42, 44, 45, 47 and 48. Also, those pairs of fingers do not correspond to resilient arms like 40, 43, and 46. These pairs of fingers define slots 50, 51, 52, 53, 54 and 55. Openings 60, 61 and 62 in elements 25 are present beneath those lower finger pairs as is clear from the figure. These openings will be seen to be important in increasing the density of ground terminations permitted by a connector of prescribed size.

Block 10 includes a conductor channel for each slot defined by the fingers of element 25. Thus, channels 12, 13, 14 and 23 correspond to slots 41, 42, 50, and 51 and twelve wires can be connected to slots 41, 42, 50, 51, 44, 45, 52, 53, 47, 48, 54, and 55. Consider that the dimensions of block 10, element 25, and the resilient arms and slot-defining fingers are as small as current technology permits. Then, an offset mirror image of block 10 and element 24 is operative to double the terminating capacity of a connector comprising such a block and metallic ground element (25).

FIG. 2 shows such a mirror image block 70 and metallic ground element 71. The two mirror image blocks can be viewed as moving together as indicated by curved arrows 80 and 81 as if they were covers of a book. Note that resilient arms 82 occupy space 60, resilient arms 83 occupy space 61 and resilient arms 84 occupy space 62. Note also that the finger pairs defining slots 90 and 92 corresponding to pair 82 of resilient arms is higher (as viewed) than the pairs of fingers defining slots 50 and 51. Similarly, the offset slot-defining finger pairs of elements 71 are either higher or lower than the opposing pairs of slot-defining fingers of element 25. Each of the slots of element 71 has an associated conductor-receiving channel in block 70. Thus, channels 99 and 100 correspond to slots 90 and 91 respectively. For the fourteen slots defined in element 71, fourteen conductors can be connected, all in the same space occupied already by the twelve conductors terminated by element 25. It is clear then that the arrangement easily doubles the maximum termination capacity of a connector.

So far we have discussed primarily the termination of ground conductors which are capable of sharing a single electrically conducting element such as element 25 or 71. But the arrangement permits high density packing of electrically isolated (i.e., signal-bearing) cables as well. FIG. 1 indicates the presence of signal cable terminations on the underside of plastic block 11 as viewed.

Figure 3:
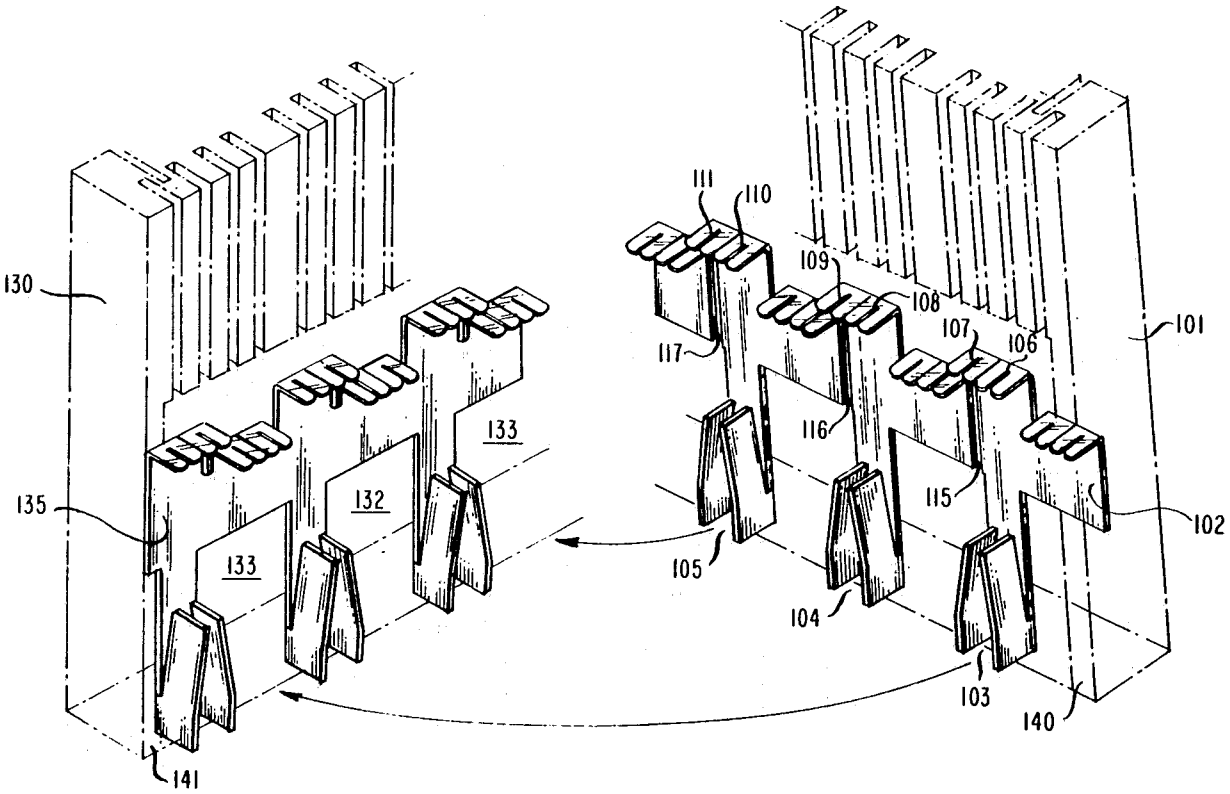
FIG. 3 is an embodiment of the basic invention.

FIG. 3 shows a plastic block 101 with an electrically conducting element 102 which define resilient arm pairs 103, 104, and 105 at its lower end and cable-receiving slots 106, 107, 108, 109, 110 and 111 at its upper end as viewed. But the terminations for signal-carrying cables are electrically isolated from one another by electrically insulating separations designated 115, 116, and 117 in FIG. 3. Such separations can be made between adjacent pairs of slot-defining fingers or, alternatively, between selected pairs, as shown, depending upon what pattern of signal distribution is required. The separations may be defined by plastic insulating material or, alternatively, individual elements bearing resilient arms at one end and slot-defining fingers at the other may be mounted on a plastic support plate with air gaps (as shown) or plastic ridges between them. In the latter instance, the support plate takes the form of a channel-defining body portion like that of prior art connectors except that a relatively large number of signal-carrying cables can be terminated electrically to a pin-receiving aperture for external connections.

Once again, block 101 can be swung into an abutting position against a second block 130 which can be taken to be the equivalent of block 10 of FIG. 2. In this instance, cable-carrying terminations nest within open spaces 131, 132, and 133 of element 135. Still the structure provides for a doubling of the number of terminations over that possible by prior art connectors.

Figure 4:
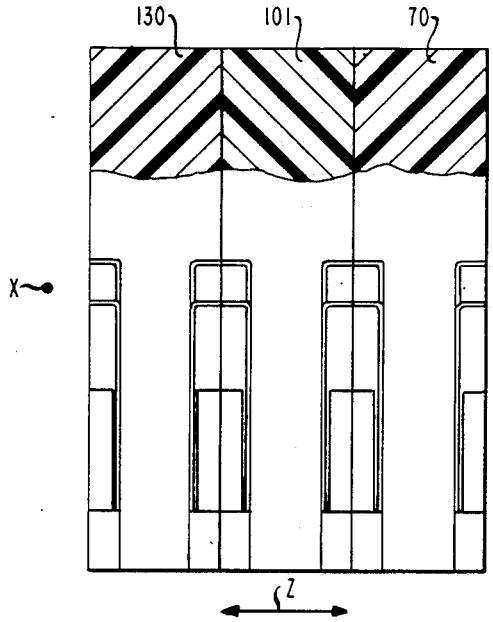
FIG. 4 shows a stacked assembly of the FIG. 2 and FIG. 3 devices.

It was stated above that, block 101 of FIG. 3 could be taken as the back side of block 10 of FIG. 2. Thus, it should be clear that blocks 130 and 101 of FIG. 3 (or 10 of FIG. 2) could be stacked with block 70 of FIG. 2 into an arrangement as shown in FIG. 4. The stack can be assembled after all cables and ground conductors are terminated thus avoiding difficulties encountered in prior art arrangements where connections have to be made in virtually inaccessible places.

The elements 102, 135, and 71 are recessed into the respective plastic blocks with edges such as 140 and 141 in FIG. 3 adapted to abut one another to provide a solid exposed edge when abutting. In this manner, all terminations are contained within the stack with cable-receiving channels exposed at one edge and pin-receiving apertures exposed at the other. The exposed faces of end blocks of a stack may be made solid without cable-receiving channels or a recess for elements like 102 or 135 thus providing a smooth and compact connector assembly.

Improvement in packing density of a connector made in accordance with the principles of this invention over that achieved by prior art connector technology is gained in each of two directions x and y as indicated by double headed arrows x and y in FIGS. 2 and 4 respectively. The gain along the x direction is based on the realization that cable-receiving channels on opposing connector portions can be made with ground conductor or cable terminations which share space relatively efficiently. The gain is achieved by arranging the slot-defining fingers at different positions along the axis of the wire or cable. Specifically, the gain in packing density along the x axis or direction is achieved by offsetting the pin-receiving, resilient arms and associated slot-defining fingers of one plane (i.e., a first plastic block) with respect to the corresponding elements of the adjacent plane so that they can nest within one another and still be electrically isolated form one another. The elevation (along the z axis) of the slot-defining fingers of one plane also alternate to permit nesting.

It may be advantageous to connect part or all of elements 25 and 71 of FIG. 2 for example. Such connection is achieved by resilient lances cut from the elements and bent outward towards the opposing element. Suitable lances are designated 120, 121, and 122 in FIG. 2. Such lances permit programmable connectors to be achieved.

What is claimed is:

1. A strip having serially spaced apart electrical terminals along the length of the strip and projecting transversely of the length of the strip, and further comprising, wire terminating means having first sets of wire terminating slots aligned along a first axis along the length of the strip, and having second sets of wire terminating slots aligned along a second axis along the length of the strip and offset from the first axis, an offset mirror image segment of said strip offset along the length of said strip, first spaces between adjacent said first sets of wire terminating slots of said strip, respective first sets of wire terminating slots of said offset mirror image segment of said strip fitting into corresponding said first spaces, second spaces between adjacent said second sets of wire terminating slots of said strip, respective second sets of wire terminating slots of said offset mirror image segment of said strip fitting into corresponding said second spaces, third spaces between adjacent terminals of said strip, and terminals projecting alternately from said strip and from said offset mirror image segment of said strip are provided by respective said terminals of said offset mirror image segment of said strip in alignment with said third spaces.

2. A strip as recited in claim 1, wherein said first sets of wire terminating slots are opposite corresponding said second spaces.

3. A strip as recited in claim 1, wherein said second sets of wire terminating slots are opposite corresponding said first spaces.

4. A strip as recited in claim 1, wherein said first sets of wire terminating slots are opposite corresponding said second spaces, and said second sets of wire terminating slots are opposite corresponding said first spaces.

5. An electrical connector, comprising, a first insulative block supporting a strip having serially spaced apart electrical terminals along the length of the strip and projecting transversely of the length of the strip, wire terminating means on said strip having first sets of wire terminating slots aligned along a first axis along the length of the strip, said wire terminating means having second sets of wire terminating slots aligned along a second axis along the length of the strip and offset from the first axis, a second insulative block supporting an offset mirror image segment of said strip offset along the length of said strip, first spaces between adjacent said first sets of wire terminating slots of said strip, respective first sets of wire terminating slots of said offset mirror image segment of said strip fitting into corresponding said first spaces, second spaces between adjacent said second sets of wire terminating slots of said strip, respective second sets of wire terminating slots of said offset mirror image segment of said strip fitting into corresponding said second spaces, third spaces between adjacent terminals of said strip, and terminals projecting alternately from said strip and from said offset mirror image segment of said strip are provided by respective said terminals of said offset mirror image segment of said strip in alignment with said third spaces.

6. An electrical connector as recited in claim 5, wherein said offset mirror image segment of said strip is divided into portions electrically isolated from one another.

7. An electrical connector as recited in claim 5, wherein said first sets of wire terminating slots are opposite corresponding said second spaces.

8. An electrical connector as recited in claim 5, wherein said second sets of wire terminating slots are opposite corresponding said first spaces.

9. An electrical connector as recited in claim 5, wherein said first sets of wire terminating slots are opposite corresponding said second spaces, and said second sets of wire terminating slots are opposite corresponding said first spaces.

* * * * *